United States Patent [19]

Lord

[11] Patent Number: 4,656,761

[45] Date of Patent: Apr. 14, 1987

[54] FOOTWEAR REINFORCEMENT

[75] Inventor: Ronald D. Lord, Willowdale, Canada

[73] Assignee: Mining Industry Research Organization of Canada, Toronto, Canada

[21] Appl. No.: 863,497

[22] Filed: May 15, 1986

[30] Foreign Application Priority Data

Jun. 26, 1985 [CA] Canada ..... 485310

[51] Int. Cl.[4] ..... A43C 13/14

[52] U.S. Cl. ..... 36/77 R; 36/72 R; 36/77 M

[58] Field of Search ..... 36/72 R, 77 R, 77 M

[56] References Cited

U.S. PATENT DOCUMENTS

| | | | |
|---|---|---|---|
| 2,393,810 | 1/1946 | Purinton | 36/72 R |
| 3,102,347 | 9/1963 | Griswold et al. | 36/72 R |
| 3,406,469 | 10/1968 | Dani | 36/77 R |
| 4,231,170 | 11/1980 | Griswold | 36/77 R |

FOREIGN PATENT DOCUMENTS

| | | | |
|---|---|---|---|
| 783319 | 4/1968 | Canada | 36/77 R |
| 660167 | 8/1935 | Fed. Rep. of Germany | 36/72 R |
| 2027661 | 12/1971 | Fed. Rep. of Germany | 36/72 R |
| 2525443 | 10/1983 | France | 36/77 R |
| 197805 | 5/1978 | Netherlands | 36/77 R |
| 678031 | 8/1952 | United Kingdom | 36/77 R |
| 2050144 | 1/1981 | United Kingdom | 36/77 R |

*Primary Examiner*—Werner H. Schroeder
*Assistant Examiner*—Steven N. Meyers
*Attorney, Agent, or Firm*—Robert F. Delbridge; Arne I. Fors

[57] ABSTRACT

A footwear reinforcement which comprises a toe cap portion having a curved end wall which curves rearwardly at the top into an upper wall and which curves on opposite sides into opposed side walls integral with the upper wall, a bottom wall integral with lower edges of the front and side walls. A series of longitudinally-spaced transversely-extending curved ribs extend from one side of the reinforcement to the other side behind the toe cap portion and are connected at their transversely opposite ends to a rearwardly extending portion of the bottom wall of the toe cap portion.

1 Claim, 2 Drawing Figures

FOOTWEAR REINFORCEMENT

This invention relates to footwear reinforcements, and more particularly to toe reinforcements which extend rearwardly to protect the upper part of the foot.

Attempts have been previously made to provide such protection by rearwardly extending a toe cap reinforcement rearwardly, but such prior proposals have not provided the foot with sufficient flexibility and protection.

It is therefore an object of the invention to provide an improved footwear reinforcement which, in addition to protecting the toe area, will also provide adequate protection of the upper part of the foot without unduly limiting foot flexibility.

According to the invention, a footwear reinforcement comprises a toe cap protion having a curved front wall curving rearwardly at the top into an upper wall and curving on opposite sides into opposed walls integral with the upper wall and a bottom wall integral with lower edges of the front and side walls. A series of longitudinally-spaced transversely-extending curved ribs extend from one side of the reinforcement to the other behind the toe cap portion, the ribs being connected at their transversely opposite ends to a rearwardly extending portion of the bottom wall of the toe cap portion.

The longitudinally-spaced transversely extending curved ribs provide adequate protection for the upper part of the foot without unduly limiting flexibility since the ribs are capable of moving towards and away from one another. The reinforcement is preferably an integral moulding if synthetic plastic material.

One embodiment of the invention will now be described by way of example, with reference to the accompanying drawings, in which.

Figure 1:
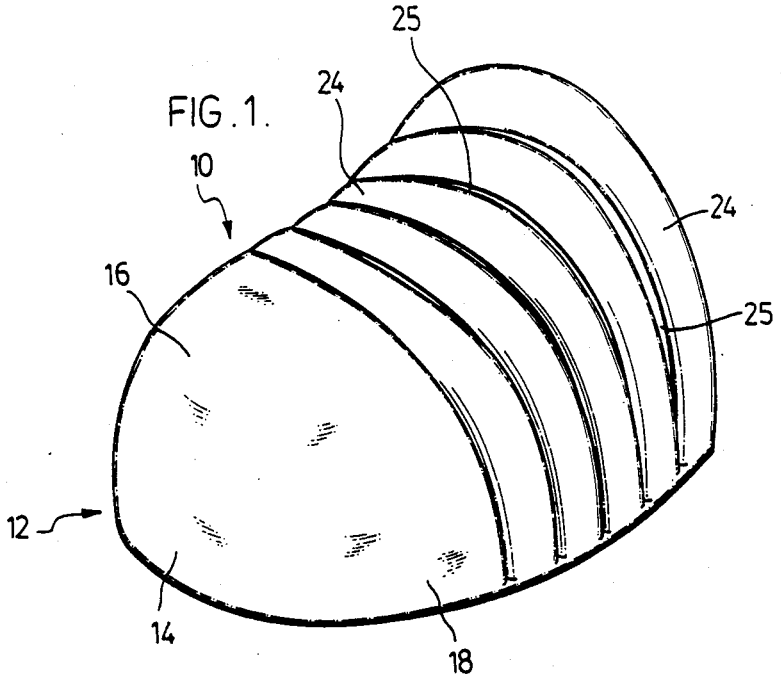
FIG. 1 is a front perspective view of a footwear reinforcement.
Figure 2:
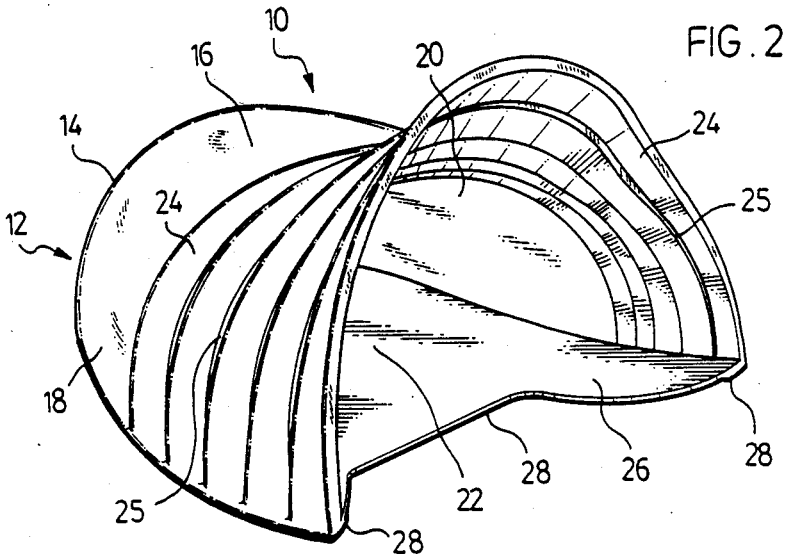
FIG. 2 is a rear perspective view thereof.

Referring to the drawing, a footwear reinforcement 10 is an integral moulding of suitable synthetic plastic material, for example a high impact material such as polycarbonate resin. Reforcement 10 comprises a rigid toe cap portion 12 having a curved front wall 14 curving rearwardly at the top into an upper wall 16 and curving on opposite sides into opposed side walls 18, 20. The toe cap portion 12 also has a bottom wall 22 integral with the lower edges of the front wall 14 and side walls 18, 20.

Rearwardly of the toe cap portion 12, a series of longitudinally-spaced transversely-extending curved ribs 24 extend from one side of the reinforcement 10 to the other. There is a gap 25 between each adjacent pair of ribs 24 over the major part of their length, the ribs 24 being connected at their opposite ends to a rearwardly extending portion 26 of the bottom wall 22 of the toe cap portion 12. The central part of the rear edge of the bottom wall extension 26 is recessed at 28 for flexibility, and the front and side peripheral edge portions 28 of the bottom wall 22 and its rearward extension 26 are thickened for increase strength. The ribs 24 gradually increase in transverse length and height in a front to rear direction so as to conform with the shape of the part of a foot.

The reinforcement 10 can easily be incorporated in an article of footwear as will be readily apparent to a person skilled in the art. For example, the reinforcement can be embedded in a moulded rubber or soft plastic boot during its manufacture by injection moulding.

The reinforcement in accordance with the invention provides adequate protection for the upper part of the foot in addition to the toe area, at the same time providing adequate flexibility to accomodate foot movement during walking. Although the toe cap portion 12 is rigid, ribs 24 can be moved forwardly by the upper surface of a foot during walking. Such movement is permitted by the gaps 25 normally present between the ribs 24 and by slight flexing of the bottom wall extension 26 at opposite ends of the rib 24.

Other embodiments of the invention will be readily apparent to a person skilled in the art, the scope of the invention being defined in the appended claims.

What I claim as new and desire to protect by Letters Patent of the United States is:

1. A footwear reinforcement formed as an integral moulding of synthetic plastic material and comprising a toe cap portion having a curved front end wall curving rearwardly at the top into an upper wall and curving on opposite sides into opposed side walls integral with the upper wall, a bottom wall integral with lower edges of the front and side walls, said bottom wall having a rearwardly extending portion, and a series if longitudinally-spaced, transversely extending curved ribs with transversely opposite ends extending from one side of the reinforcement to the other side behind the toe cap portion and integral at their transversely opposite ends with the rearwardly extending portion of the bottom wall of the toe cap portion.

* * * * *